US012796836B2

(12) United States Patent
Southworth et al.

(10) Patent No.: US 12,796,836 B2
(45) Date of Patent: Nov. 17, 2026

(54) HIGH CHAIR ATTACHMENT FOR CATCHING FOOD AND OTHER OBJECTS

(71) Applicants: Scott Douglas Southworth, Lone Tree, CO (US); Chase Puckett, Denver, CO (US)

(72) Inventors: Scott Douglas Southworth, Lone Tree, CO (US); Chase Puckett, Denver, CO (US)

(73) Assignee: AOD HOLDCO LLC, Peapack, NJ (US)

( * ) Notice: Subject to any disclaimer, the term of this patent is extended or adjusted under 35 U.S.C. 154(b) by 0 days.

(21) Appl. No.: 18/655,279

(22) Filed: May 5, 2024

(65) Prior Publication Data

US 2024/0365985 A1 Nov. 7, 2024

Related U.S. Application Data

(60) Provisional application No. 63/464,222, filed on May 5, 2023.

(51) Int. Cl.
*A47D 15/00* (2006.01)
*A47C 7/62* (2006.01)

(52) U.S. Cl.
CPC ..... *A47D 15/00* (2013.01); *A47C 7/626* (2018.08)

(58) Field of Classification Search
CPC ..... A47D 15/00; A47C 7/626
USPC ..... 297/182
See application file for complete search history.

(56) References Cited

U.S. PATENT DOCUMENTS

| | | | | |
|---|---|---|---|---|
| 4,659,143 | A * | 4/1987 | MacLennan | A47D 1/106 297/174 CS |
| 4,848,834 | A * | 7/1989 | Linski | A47D 1/00 297/182 |
| 8,727,435 | B2 * | 5/2014 | Centracco | A47D 1/10 2/49.3 |
| 2008/0185881 | A1 * | 8/2008 | Romaniuk | A47D 15/00 297/182 |
| 2009/0127917 | A1 * | 5/2009 | Foenander | A47D 1/00 29/428 |
| 2010/0013277 | A1 * | 1/2010 | O'Toole | A47D 1/00 297/182 |
| 2012/0286546 | A1 * | 11/2012 | Ballard | A47D 15/00 297/182 |
| 2015/0320234 | A1 * | 11/2015 | Ing | A47D 1/0085 297/182 |

* cited by examiner

*Primary Examiner* — David R Dunn
*Assistant Examiner* — Tania Abraham
(74) *Attorney, Agent, or Firm* — DENTONS Durham Jones Pinegar

(57) ABSTRACT

An apparatus or an attachment for a high chair that is used to catch food and/or other items. The apparatus includes a substantially planar body and a shroud that extends from a top surface of the body. The shroud may at least partially surround and be removably coupled to a portion of the high chair. The shroud may also at least partially surround an opening defined by the body. The apparatus also includes funnel that is removably coupled to a bottom surface of the body. The funnel is also positioned at, near or around the opening defined by the body. Any food that is dropped from the high chair may land on the body. The food may then be scooped or swept into the opening and subsequently fall into the funnel. The funnel may then be removed from the body and cleaned/emptied.

20 Claims, 6 Drawing Sheets

HIGH CHAIR ATTACHMENT FOR CATCHING FOOD AND OTHER OBJECTS

CROSS-REFERENCE TO RELATED APPLICATION

The present application is a non-provisional application of, and claims priority to, U.S. Provisional Application No. 63/464,222 filed May 5, 2023 and titled High Chair Attachment For Catching Food and Other Objects, the entire disclosure of which is hereby incorporated by reference in its entirety.

BACKGROUND

Babies and toddlers, while cute, are often messy eaters. At times, more food ends up on the floor and/or in a seat of a high chair in which the baby or toddler is sitting than what the baby or toddler actually eats. Cleaning food up off the floor and/or from the high chair can be a time consuming and messy process-especially depending on a type of floor the high chair is sitting on. Additionally, if a pet is in the house, any food that gets dropped may be eaten by the pet.

SUMMARY

The present disclosure describes an apparatus or an attachment that may be removably coupled to a high chair. The apparatus includes a substantially planar body that is used to catch food or other items that may be dropped from a high chair. The apparatus also includes a shroud that extends from a top surface of the body. The shroud may at least partially surround and be removably coupled to a portion of the high chair. The shroud may also at least partially surround an opening defined by the body. The apparatus also includes funnel, cup, or other such device that is removably coupled to a bottom surface of the body. The funnel is also positioned at, near or around the opening defined by the body. Any food or other items that is dropped from the high chair may land on the body. The food may then be scooped or swept into the opening and subsequently fall into the funnel. The funnel may then be removed from the body and cleaned/emptied.

Accordingly, examples of the present disclosure describe an attachment for a high chair. In an example, the attachment includes a body having a top surface and a bottom surface. The body may define an opening. A shroud extends from the top surface of the body. The shroud may be proximate to and at least partially surround the opening. The shroud may also include a fastener that secures an upper portion of the shroud to a chair portion of the high chair. A funnel is coupled to the bottom surface of the body proximate to and at least partially surrounding the opening.

Also described is an apparatus for catching items dropped from a high chair. In an example, the apparatus includes an arc shaped body defining an opening within a perimeter of the arc shaped body. A shroud extends from a top surface of the arc shaped body and at least partially surrounds the opening. In an example, the shroud includes a fastener that enables the shroud to be removably coupled to a portion of the high chair. A funnel is removably coupled to a bottom surface of the arc shaped body. In an example, the funnel at least partially surrounds the opening.

In another example, the present disclosure describes an apparatus that includes a body defining an opening within a perimeter of the body and a shroud extending from a top surface of the body. The shroud at least partially surrounds the opening. The apparatus also includes a plurality of fasteners that extend from the body. A funnel is also coupled to a bottom surface of the body and at least partially surrounds the opening.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

Non-limiting and non-exhaustive examples are described with reference to the following Figures.

DETAILED DESCRIPTION

In the following detailed description, references are made to the accompanying drawings that form a part hereof, and in which are shown by way of illustrations specific embodiments or examples. These aspects may be combined, other aspects may be utilized, and structural changes may be made without departing from the present disclosure. The following detailed description is therefore not to be taken in a limiting sense, and the scope of the present disclosure is defined by the appended claims and their equivalents.

The present application describes an apparatus that may be removably coupled to a high chair. The apparatus may be used to catch food and/or other items that may be dropped from an individual that is sitting in the high chair. The apparatus may be used to protect the floor on which the high chair is located, enable an individual to easily clean up items that are dropped from the high chair and help prevent pets from eating the food and/or items that have been dropped.

As will be explained in greater detail herein, the apparatus includes a body. The body may be a circle, a half circle or any other shape. The body defines a hole or opening within a perimeter of the body. A shroud extends from a top surface of the body and at least partially surrounds the opening in the body. The shroud may include a fastener that enables the shroud to be coupled to a portion (e.g., a chair portion) of the high chair. A funnel is removably coupled to a bottom side or surface of the body. The funnel is positioned proximate to the opening and may be used to catch food or items that have been dropped onto the body.

The apparatus will be shown and described in greater detail with respect to FIG. 1-FIG. 6.

Figure 1A:
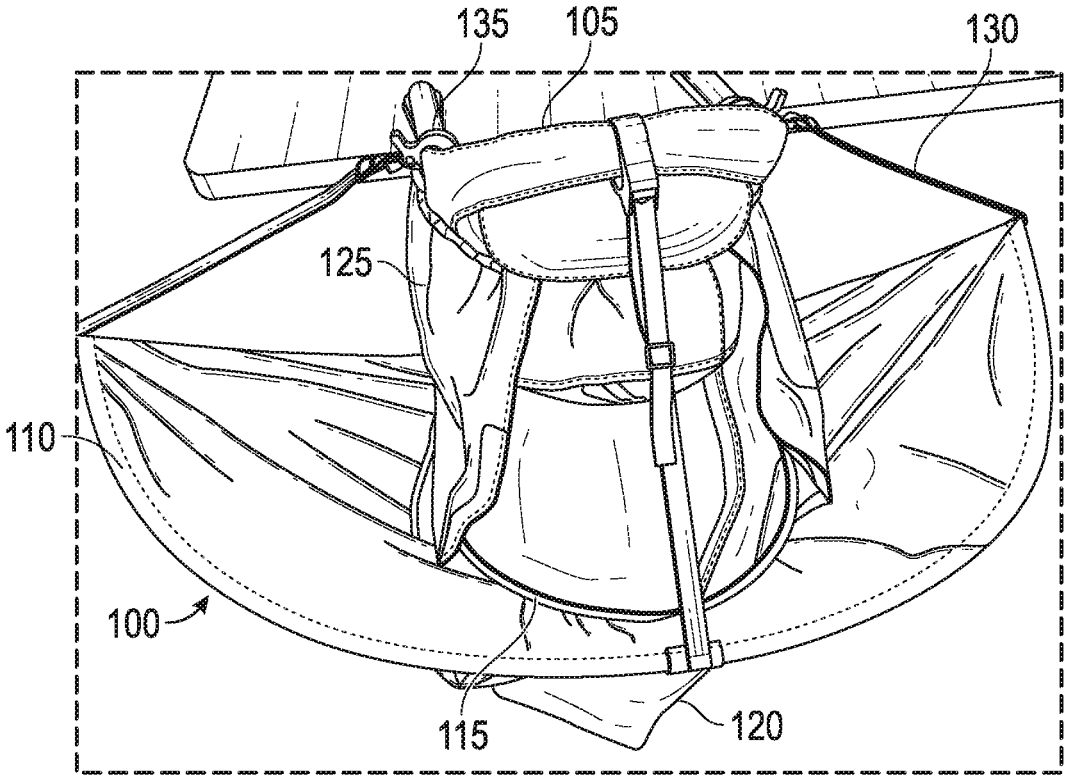
FIG. 1A illustrates an apparatus being removably coupled to a high chair according to an example.

FIG. 1A illustrates an apparatus 100 being removably coupled to a high chair 105 according to an example. Although the example of FIG. 1A (and FIG. 1B) are shown with respect to a high chair that is mounted to a counter, the apparatus 100 may be mounted to any type of high chair or other type of chair that is used to feed a toddler, a baby or other individual.

In an example, the apparatus 100 includes a body 110. In the example shown, the body 110 is a semicircle or otherwise has an arc shape. Although an arc or a semicircle is shown and described, the body 110 may be in any shape (e.g., square, rectangular, triangular).

Figure 4:
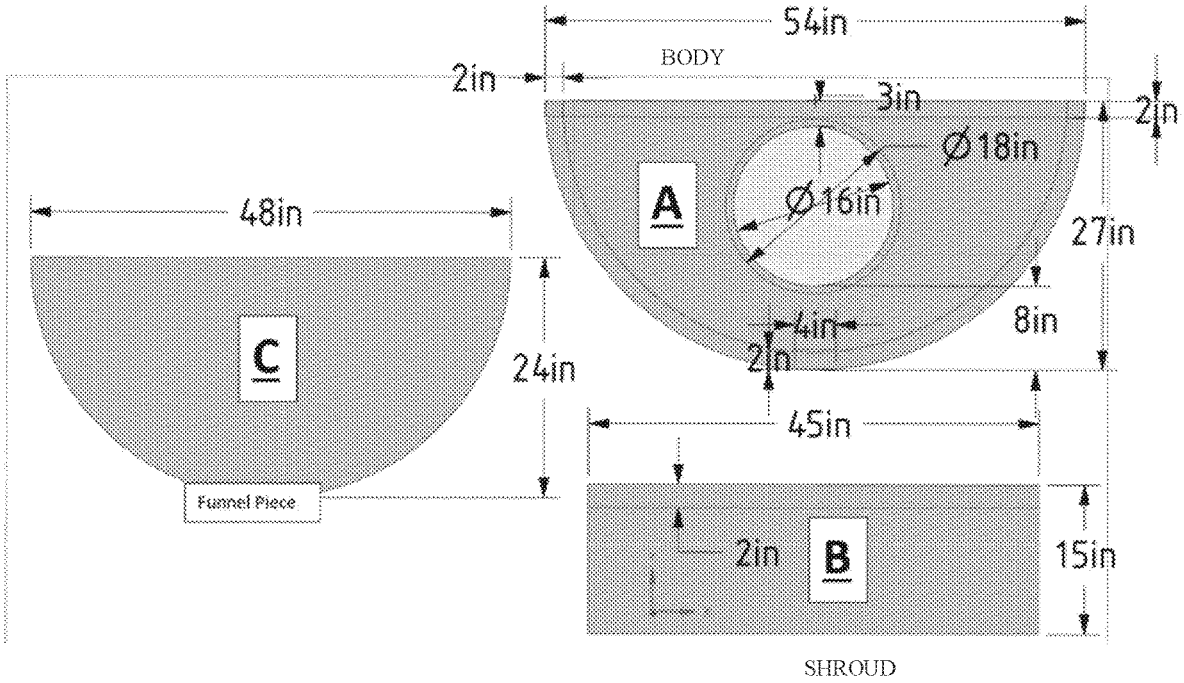
FIG. 4 illustrates example dimensions of various components of an apparatus such as shown and described herein. In an example, although specific dimensions are given, other dimensions may be used.

The body 110 may measure approximately forty-eight inches from a proximal end to a distal end along its widest length and have a width of approximately twenty-seven inches. Although specific measurements are given, the body 110 may have any number of different measurements. Example measurements of the body 110, along with other components/features of the apparatus 100 are shown in FIG. 4.

The body 110 may be comprised of nylon, canvas, plastic, or any other materials, or a combination thereof. In an example, the primary purpose of the body 110 is to catch food and/or other items that a toddler may drop/throw from a chair portion of the high chair 105. As such, it may be desirable that the material that comprises the body 110 is easily cleaned and/or enables food to be easily scooped, swept and/or pushed into an opening 115 and/or corresponding funnel 120 associated with the apparatus 100.

In an example, the body 110 may include support bars or beams provided around the perimeter. The support bars help ensure the body 110 is taut or substantially taut. As such, it may be easier to sweep food and/or other items that have fallen on the body to the opening 115. The support bars or beams may be removably coupled within the perimeter of the body 110. Therefore, in some examples, the support bars or beams may be removed from the perimeter of the body 110 and the body may be folded and/or rolled and subsequently stored.

In an example, the body 110 may define an opening 115. The opening 115 may be provided within a perimeter of the body 110. For example, the opening 115 may be positioned approximately three inches from a first side of the body and approximately eight inches from a second side of the body 110. Additionally, the opening 115 may have a diameter of approximately sixteen inches. Although specific measurements are given, these are for example purposes only and the opening 115 may be provided at a number of different locations within the body 110 and/or have any number of different sizes.

The apparatus 100 may also include a shroud 125. The shroud 125 may extend from a top surface of the body 110. For example, the shroud 125 may extend approximately fifteen inches from the top surface of the body 110 although other lengths are contemplated.

The shroud 125 may be positioned at or near the opening 115. In an example, the shroud 125 may at least partially surround the opening 115. In an example, the shroud 125 is configured in a box-like configuration such that at least three sides of the shroud 125 surround the opening 115. For example, the shroud 125 may have an origin point or otherwise begin at a first side of the opening, extend around a front side of the opening 115 and/or the high chair 105, and terminate at or near a second side of the opening 115.

In another example, the shroud 125 may be arranged in a triangular, circular or other configuration to at least partially surround the opening 115. The shroud 125 may be open near the back of the opening 115 such as shown in FIG. 1A. As such, food and/or other materials may be scooped and/or swept into the opening 115 in places at which the shroud 115 does not surround the opening 115. In some examples, the shroud 125 may at least partially cover the front of the high chair 105. As such, any food that is dropped in the chair of the high chair 105 may be directed into the opening 115 by a front portion of the shroud 125.

Figure 1B:
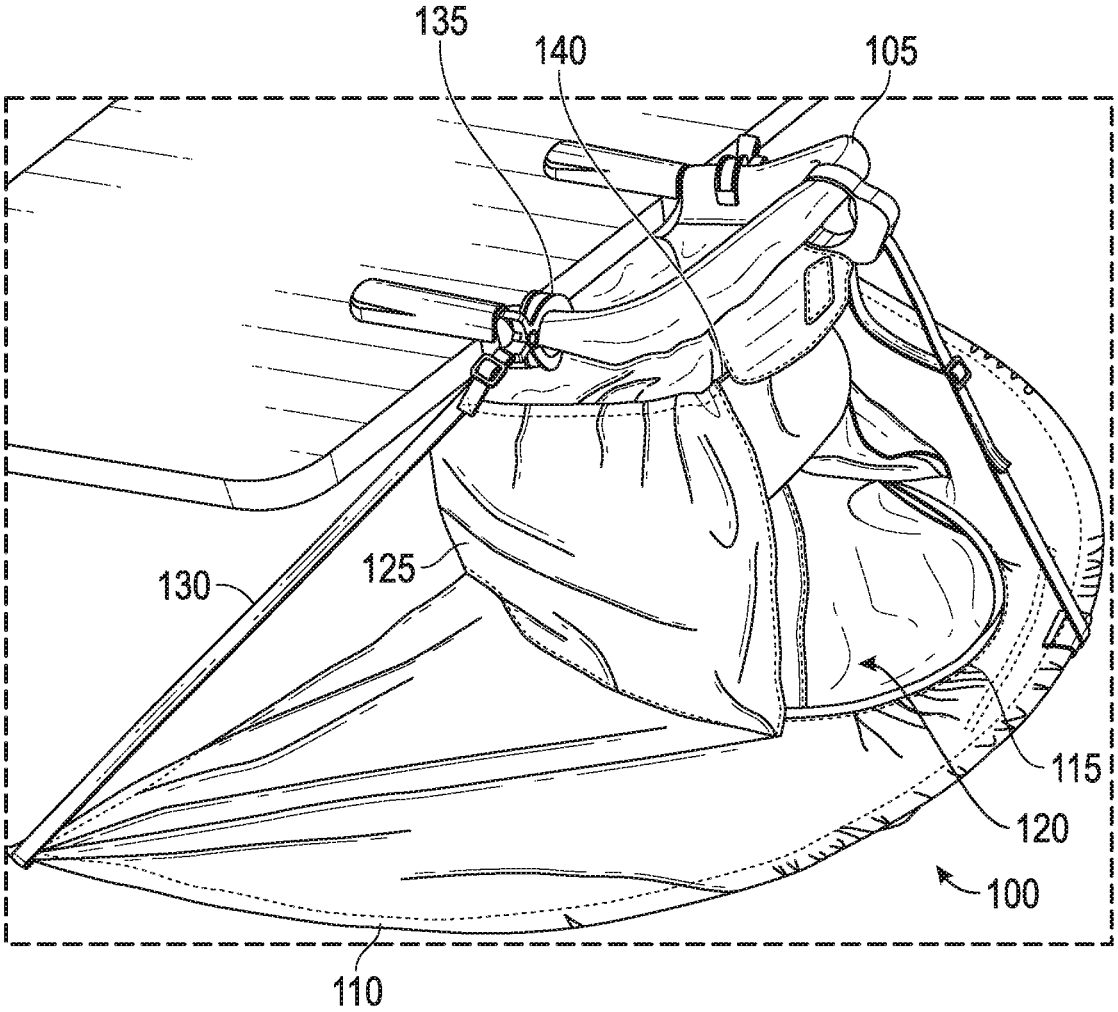
FIG. 1B illustrates another view of the apparatus being removably coupled to the high chair of FIG. 1A according to an example.

The top portion of the shroud 125 may include a securement feature 140 (FIG. 1B). The securement feature 140 may be an elastic cord, a strap, hook and loop fasteners, clips, suction cups, snaps, buttons, fasteners, buckles, zippers and the like, or another such feature that enables the top portion of the shroud 125 to be removably coupled to the chair portion of the high chair 105 (or another portion of the high chair 105).

The apparatus 100 may also include one or more straps 130 that extend from the perimeter of the body 110. Although straps are specifically mentioned, other features may be used. In another example, the straps may be omitted. In yet another example, support members may extend from a bottom surface of the body 110 to help ensure the body 110 is taut. The straps 130 include a coupling feature 135 that is removably coupled to the chair portion and/or another portion of the high chair 105. In an example, the coupling feature 135 is a hook or clamp. However, it is contemplated that other coupling features may be used including, but not limited to, hook and loop fasteners, clips, suction cups, snaps, buttons, fasteners, buckles, zippers and the like.

As briefly mentioned above, the apparatus 100 also includes a funnel 120. In an example, the funnel 120 is removably coupled to a bottom surface of the body 110 at and/or near the opening 115. The funnel 120 may be in the shape of a cone or other shape that catches food and/or other items that are dropped into the opening 115. The funnel 120 may be made of the same material as the body 110 or different materials from the body 110. In an example, the funnel 120 may have a shape that helps an individual distinguish a front portion and a back portion and/or how to removably couple the funnel to the body 110. For example, one side of the funnel 120 may have a straight edge or portion while the rest of the funnel is circular.

As indicated above, the funnel 120 may be removably coupled to the bottom surface of the body. As such, hook & loop fasteners, snaps, buttons, zippers and the like may be used to removably couple the funnel 120 to the body 110.

Once food and/or other items have been caught by the funnel 120, the funnel 120 may be removed, emptied, washed and/or replaced on the bottom surface of the body 110.

FIG. 1B illustrates another view of the apparatus 100 being removably coupled to the high chair 105 of FIG. 1A according to an example.

Figure 2:
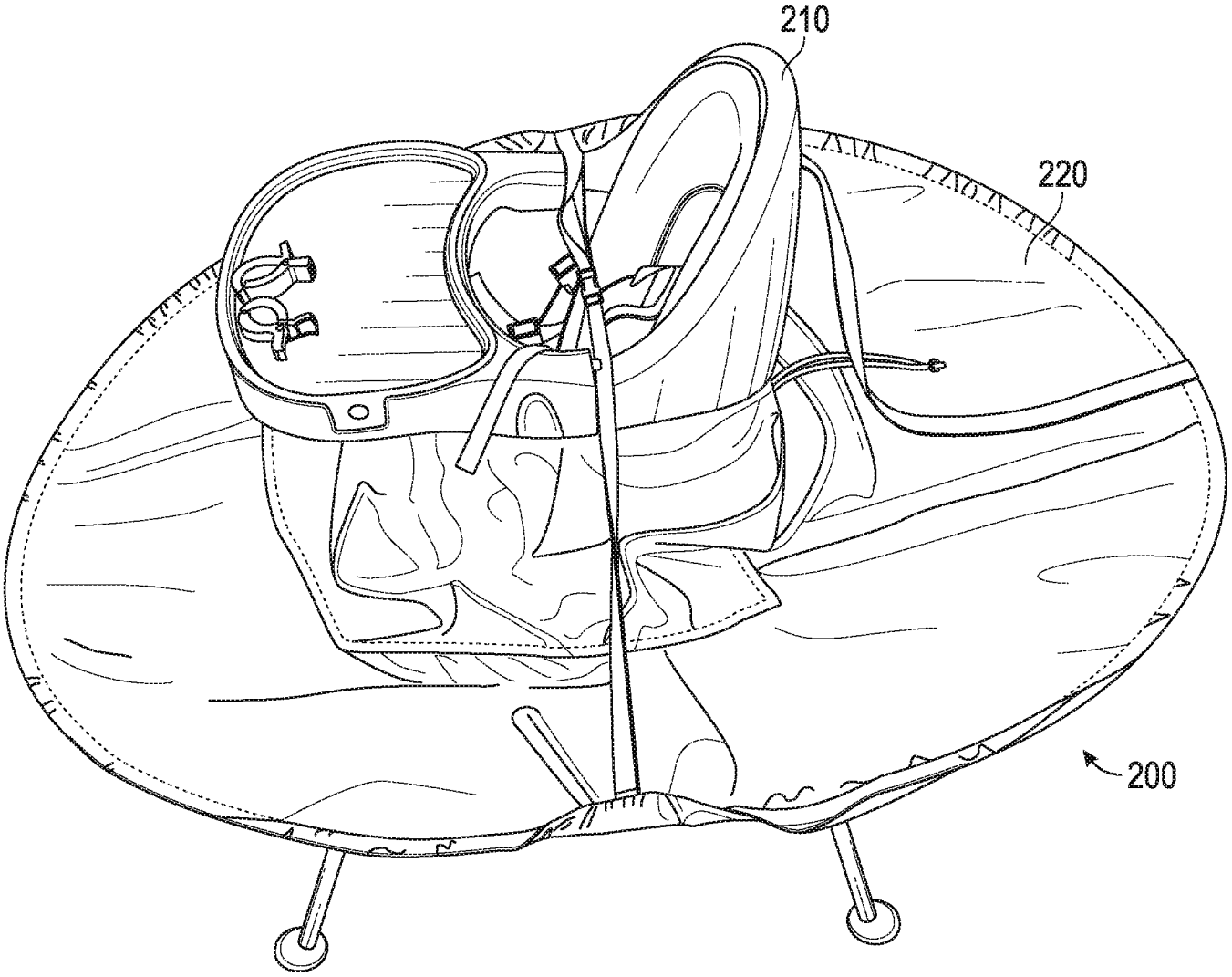
FIG. 2 illustrates another apparatus being removably coupled to a high chair according to an example.

FIG. 2 illustrates another apparatus 200 being removably coupled to a high chair 210 according to an example. In an example, the apparatus 200 includes similar features to the apparatus 100 shown and described with respect to FIG. 1A-FIG. 1B. However, in this example, a body 220 of the apparatus 210 is circular or substantially circular. Although a circle is shown, the body 220 may be any shape.

Figure 3:
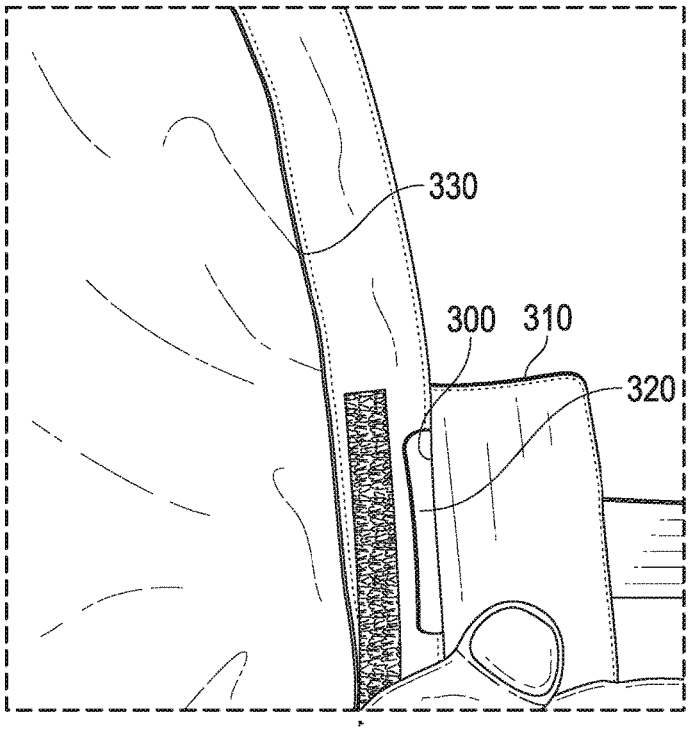
FIG. 3 illustrates how a perimeter of body of an apparatus may include an opening into which one or more support bars may be placed according to an example.

FIG. 3 illustrates how a perimeter of body 330 of an apparatus may include an opening 320 into which one or more support bars 300 may be placed according to an example. In an example, the body 330 may be similar to the body 110 shown and described with respect to FIG. 1A.

As shown in FIG. 3, the perimeter of the body 330 includes or otherwise defines an opening 320 into which one or more support bars 300 may be placed. In an example, the one or more support bars are removably coupled together. Additionally, the body 330 may include a cover 310 that moves from a first position to cover the opening 320 to a second position that exposes the opening 320. The cover 310 may be made from any suitable material and may be releasably secured to the body 330.

FIG. 4 illustrates example dimensions of various components of an apparatus such as shown and described herein. In an example, although specific dimensions are given, other dimensions may be used.

Figure 5A:
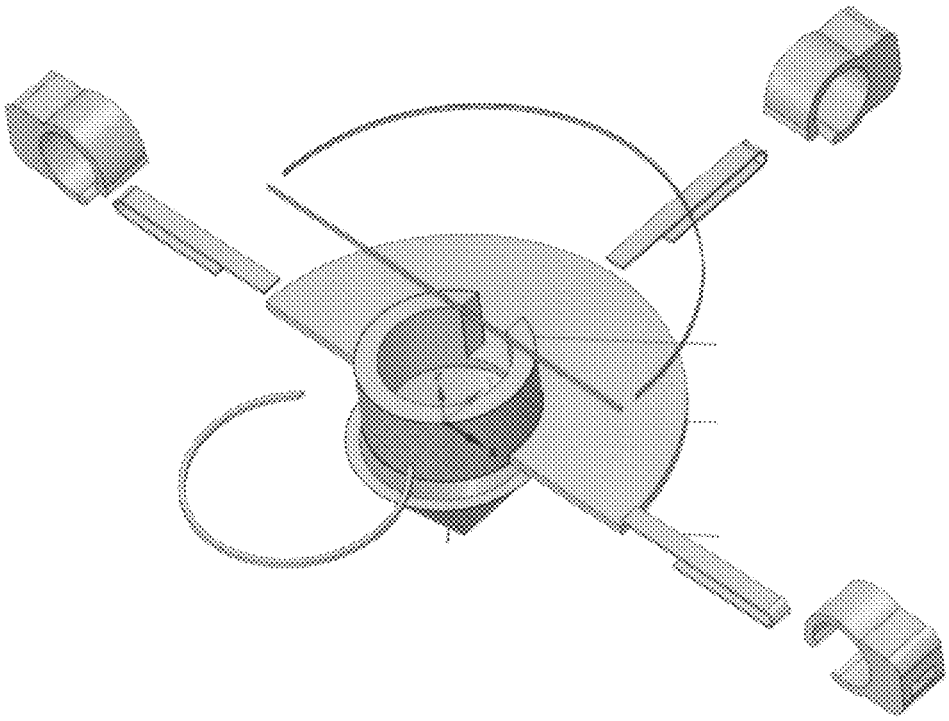
FIG. 5A-FIG. 5B illustrate an exploded view of an apparatus 500 according to an example.
Figure 5B:
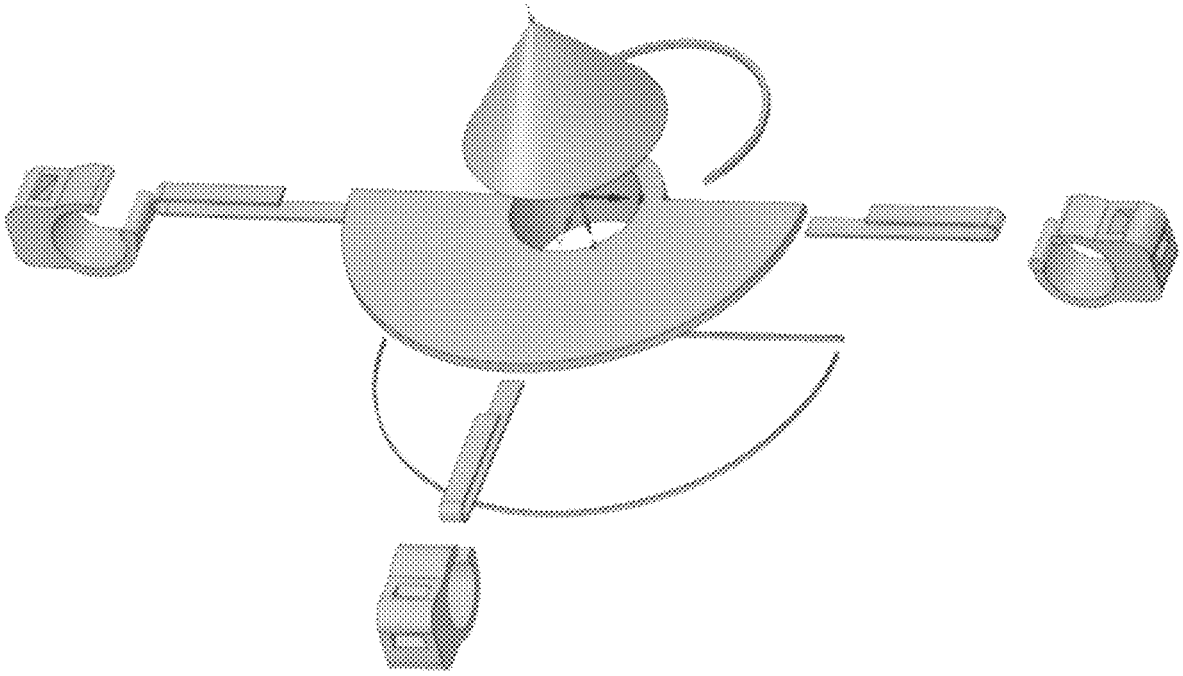

FIG. 5A-FIG. 5B illustrate an exploded view of an apparatus 500 according to an example. In an example, the apparatus 500, and the various features of the apparatus 500, may be similar to the various components and features of the apparatus 100 shown and described with respect to FIG. 1A-FIG. 1B.

Figure 6:
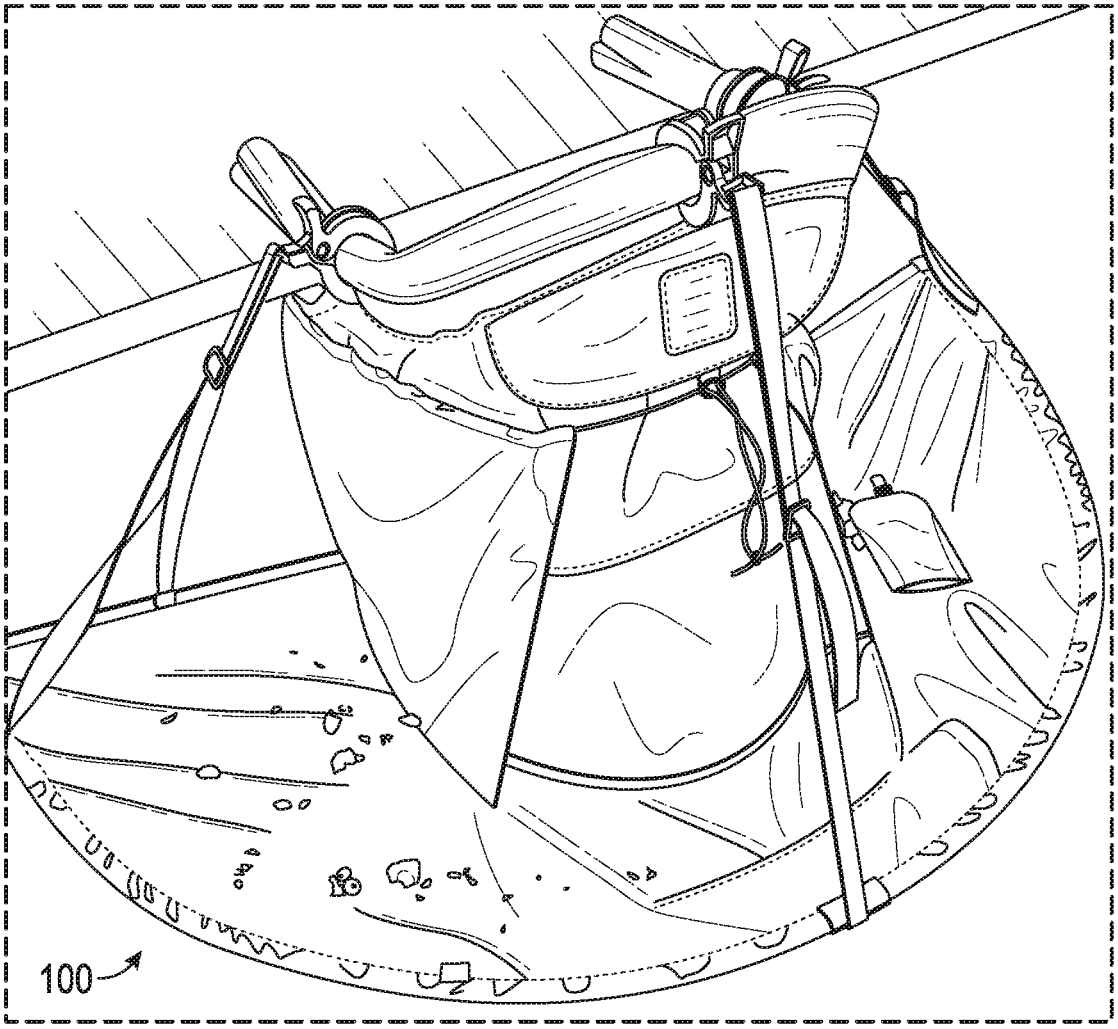
FIG. 6 illustrates how the apparatus shown and described with respect to FIG. 1A-FIG. 1B can catch food and/or other items according to an example.

FIG. 6 illustrates how the apparatus 100 shown and described with respect to FIG. 1A-FIG. 1B can catch food and/or other items according to an example.

The description and illustration of one or more aspects provided in the present disclosure are not intended to limit or restrict the scope of the disclosure in any way. The aspects, examples, and details provided in this disclosure are considered sufficient to convey possession and enable others to make and use the best mode of claimed disclosure.

The claimed disclosure should not be construed as being limited to any aspect, example, or detail provided in this disclosure. Regardless of whether shown and described in combination or separately, the various features are intended to be selectively rearranged, included or omitted to produce various embodiments with a particular set of features. Having been provided with the description and illustration of the present application, one skilled in the art may envision variations, modifications, and alternate aspects falling within the spirit of the broader aspects of the general inventive concept embodied in this application that do not depart from the broader scope of the claimed disclosure.

References to an element herein using a designation such as "first," "second," and so forth does not generally limit the quantity or order of those elements. Rather, these designations may be used as a method of distinguishing between two or more elements or instances of an element. Thus, reference to first and second elements does not mean that only two elements may be used or that the first element precedes the second element. Additionally, unless otherwise stated, a set of elements may include one or more elements.

Terminology in the form of "at least one of A, B, or C" or "A, B, C, or any combination thereof" used in the description or the claims means "A or B or C or any combination of these elements." For example, this terminology may include A, or B, or C, or A and B, or A and C, or A and B and C, or 2A, or 2B, or 2C, or 2A and B, and so on. As an additional example, "at least one of: A, B, or C" is intended to cover A, B, C, A-B, A-C, B-C, and A-B-C, as well as multiples of the same members. Likewise, "at least one of: A, B, and C" is intended to cover A, B, C, A-B, A-C, B-C, and A-B-C, as well as multiples of the same members.

Similarly, as used herein, a phrase referring to a list of items linked with "and/or" refers to any combination of the items. As an example, "A and/or B" is intended to cover A alone, B alone, or A and B together. As another example, "A, B and/or C" is intended to cover A alone, B alone, C alone, A and B together, A and C together, B and C together, or A, B, and C together.

What is claimed is:

1. An attachment for a high chair, comprising:

a body having a top surface and a bottom surface, the body defining an opening; and a shroud extending from the top surface of the body, the shroud being proximate to and at least partially surrounding the opening and including a fastener that secures an upper portion of the shroud to a chair portion of the high chair, wherein the shroud at least substantially covers a front portion of the chair portion of the high chair and directs dropped items through the opening and into a funnel coupled to the bottom surface of the body proximate to and at least partially surrounding the opening.

2. The attachment of claim 1, wherein the body comprises an arc shape.

3. The attachment of claim 1, further comprising a plurality of straps extending from different points on a perimeter of the body.

4. The attachment of claim 3, further comprising a connector provided on a distal end of each of the plurality of straps, each connector enabling each of the plurality of straps to be removably coupled to the chair portion of the high chair.

5. The attachment of claim 1, wherein the funnel is removably coupled to the bottom surface of the body.

6. The attachment of claim 1, further comprising at least one support bar provided in a perimeter of the body, the support bar causing the body to be substantially taut.

7. The attachment of claim 1, wherein the body is comprised of nylon or a canvas.

8. The attachment of claim 1, wherein the body is circular.

9. The attachment of claim 1, further comprising at least one support bar removably coupled within a perimeter of the body, wherein when the at least one support bar is removed, the body is configured to be folded or rolled for storage.

10. An apparatus for catching items dropped from a high chair, comprising:

an arc shaped body defining an opening within a perimeter of the arc shaped body;

a shroud extending from a top surface of the arc shaped body and at least partially surrounding the opening, the shroud comprising a fastener to removably couple the shroud to a portion of the high chair; and a funnel removably coupled to a bottom surface of the arc shaped body and at least partially surrounding the opening, wherein the shroud at least substantially covers a front portion of the high chair and directs dropped items through the opening and into the funnel.

11. The apparatus of claim 10, further comprising at least two straps extending from different points of the perimeter of the arc shaped body.

12. The apparatus of claim 11, further comprising a first connector provided on a distal end of a first strap of the at least two straps and a second connector provided on a distal end of a second strap of the at least two straps, wherein the first connector is removably coupled to a first portion of the high chair and the second connector is removably coupled to a second portion of the high chair.

13. The apparatus of claim 10, further comprising at least one support member coupled to the arc shaped body.

14. The apparatus of claim 13, wherein the support member is provided in the perimeter of the arc shaped body and wherein the support member causes the arc shaped body to be substantially taut.

15. The apparatus of claim 10, wherein the shroud is configured in a box-like configuration such that at least three sides of the shroud surround the opening.

16. An apparatus, comprising:

a body defining an opening within a perimeter of the body;

a funnel coupled to a bottom surface of the body and at least partially surrounding the opening;

a shroud extending from a top surface of the body and at least partially surrounding the opening and substantially covering a front portion of a high chair and directing dropped items through the opening and into the funnel; and a plurality of fasteners extending from the body.

17. The apparatus of claim 16, wherein the body is a half-circle.

18. The apparatus of claim 16, wherein the body is circular.

19. The apparatus of claim 16, wherein the funnel is removably coupled to the bottom surface of the body.

20. The apparatus of claim 16, wherein the fasteners are removably coupleable to different portions of a high chair.

* * * * *